US006277038B1

(12) United States Patent
Sullivan

(10) Patent No.: US 6,277,038 B1
(45) **Date of Patent: *Aug. 21, 2001**

(54) GOLF BALL WITH NON-CIRCULAR SICKLE-SHAPED DIMPLES

(75) Inventor: Michael J. Sullivan, Chicopee, MA (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/450,655

(22) Filed: Nov. 30, 1999

Related U.S. Application Data

(62) Division of application No. 09/228,291, filed on Jan. 11, 1999, now Pat. No. 6,019,688.

(51) Int. Cl.[7] ..... A63B 37/14

(52) U.S. Cl. ..... 473/383

(58) Field of Search ..... 473/378–384

(56) References Cited

U.S. PATENT DOCUMENTS

| | | | | |
|---|---|---|---|---|
| D. 44,109 | * | 5/1913 | Penney | 473/384 |
| D. 44,227 | * | 6/1913 | Wood | 473/378 |
| 1,517,514 | | 12/1924 | Hunt . | |
| 1,656,408 | | 1/1928 | Young . | |
| 5,005,838 | | 4/1991 | Oka . | |
| 5,033,750 | | 7/1991 | Yamagishi et al. . | |
| 5,503,398 | * | 4/1996 | Lu | 473/384 |
| 5,518,246 | | 5/1996 | Moriyama et al. . | |
| 6,019,688 | * | 2/2000 | Sullivan | 473/383 |

* cited by examiner

*Primary Examiner*—Mark S. Graham
*Assistant Examiner*—Raeann Gorden

(57) ABSTRACT

A new dimple configuration for the surface of a golf ball is characterized by non-circular sickle-shaped dimples. Each dimple includes a convex outer edge having a first radial configuration and an inner edge having a second radial configuration. Preferably, the inner edge is concave and the inner and outer edges meet at opposite sides of the dimple. The area between the edges is recessed relative to the golf ball surface. At least some of the sickle-shaped dimples are arranged in an interlocking pattern to maximize the dimpled area of the golf ball surface.

2 Claims, 2 Drawing Sheets

GOLF BALL WITH NON-CIRCULAR SICKLE-SHAPED DIMPLES

This application is a division of U.S. patent application Ser. No. 09/228,291 filed Jan. 11, 1999, now U.S. Pat. No. 6,019,688.

BACKGROUND OF THE INVENTION

The present invention relates to a new configuration for the dimples on a golf ball surface which improve the flight characteristics of the ball.

According to the United States Golf Association (U.S.G.A.) rules, a golf ball may not have a weight in excess of 1.620 ounces or a diameter smaller than 1.680 inches. The initial velocity of balls conforming to U.S.G.A. regulations may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance of plus 4% and a 2% tolerance for test error.

These specifications limit how far a struck golf ball will travel in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and, thus, a lower drag when traveling through the air. Increasing initial velocity increases the distance the ball will travel.

Drag on a golf ball is also reduced by forming a plurality of dimples, generally circular, in the outer surface of the ball. The dimples serve to reduce the pressure differential between the front and rear of the ball as it travels through the air.

BRIEF DESCRIPTION OF THE PRIOR ART

Numerous dimple configurations for use on golf balls are well-known in the patented prior art. While circular dimples are the most common, non-circular dimples are also used on golf balls. For example, the Wood U.S. design Pat. No. 44,227 discloses a design for a golf ball with an outer surface having a plurality of crescent-moon dimples thereon and the Penny U.S. design Pat. No. 44,109 discloses a design for a golf ball with half-moon shaped dimples. Elongated, tear-drop shaped dimples are disclosed in the Lavallee U.S. Pat. No. 5,356,150 which is assigned to the same owner as the present application.

While these dimpled golf balls of the prior art differ from the more conventional circular dimpled balls, they each have different flight characteristics and limitations to the per cent of dimple coverage on the surface of the ball. The present invention was developed in order to create a dimpled golf ball with improved flight characteristics which also conforms with U.S.G.A. standards.

SUMMARY OF THE INVENTION

Accordingly, it is a primary object of the present invention to provide a golf ball having a spherical surface with a plurality of uniquely configured dimples thereon. Each dimple includes and outer edge having a first radial configuration and an inner edge having a second configuration different from the first radial configuration. The inner and outer edges meet at opposite sides of the dimple with the are between the edges being recessed relative to the golf ball surface to define a dimple having a sickle configuration.

According to a more particular embodiment of the invention, the second configuration of the inner edge is a radial configuration whose radius is less than the first radial configuration, thereby defining a dimple with a convex outer edge and a concave inner edge, the edges joining at either space points or along a curved surface at the opposite sides of the dimple.

It is yet another object of the invention to provide a golf ball wherein a side end of one dimple is arranged within a convex area defined by the inner edge of an adjacent dimple, thereby to define an interlocking pattern of dimples on the golf ball surface.

DETAILED DESCRIPTION

Figure 1:
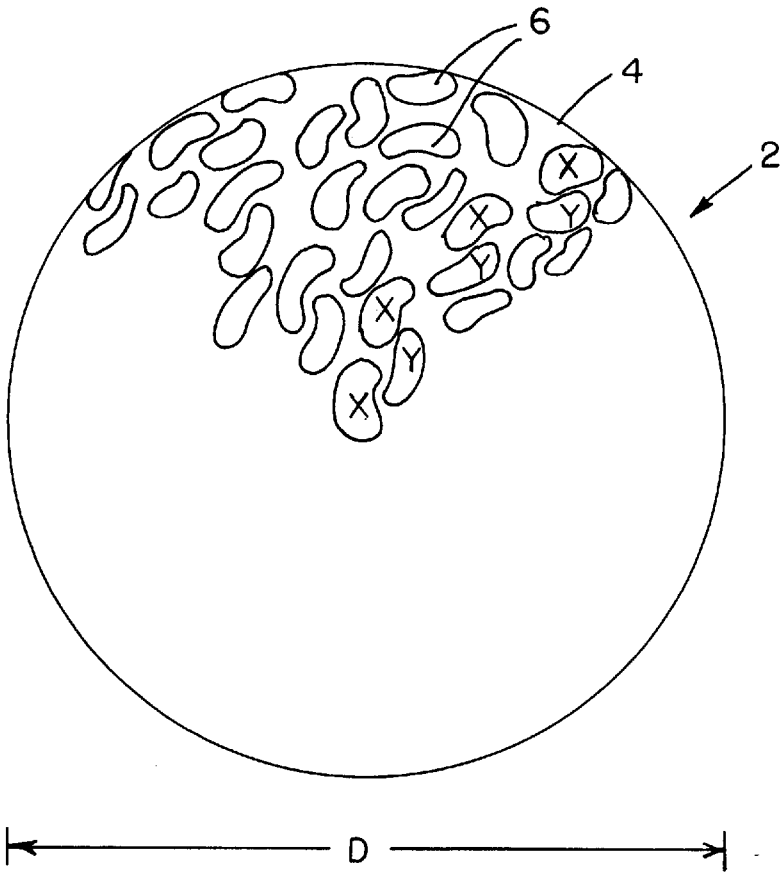
FIG. 1 is a plan view of a golf ball containing non-circular sickle-shaped dimples according to the invention.
Figure 2:
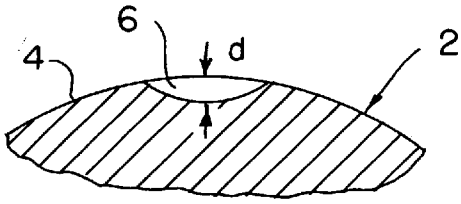
FIG. 2 is a sectional view of a dimple showing the recessed portion thereof relative to the surface of the golf ball of FIG. 1.

In FIG. 1, there is shown a golf ball 2 having a spherical surface 4 in which are formed a plurality of dimples 6. In order to comply with U.S.G.A. rules, the diameter D of the golf ball is at least 1.680 inches. The dimples have a non-circular sickle-shape and are arranged across the entire surface of the ball. Each dimple includes a recess which extends into the golf ball surface 4 to a depth d as shown in FIG. 2.

Figure 3:
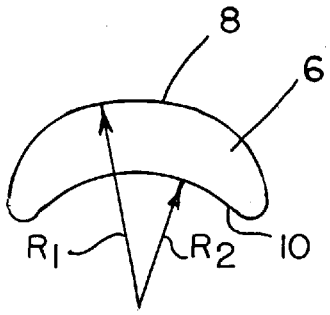
FIGS. 3–8 are plan views of different dimple configurations, respectively, according to the invention.
Figure 4:
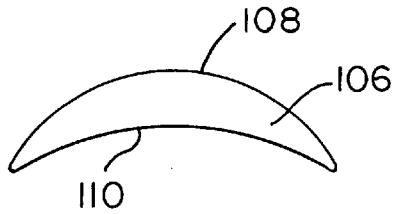

Referring now to FIG. 3, the preferred configuration of the sickle-shaped dimple 6 will be described. The dimple includes an outer edge 8 having a first generally radial configuration RI and an inner edge 10 having a second radial configuration R2, with R2 being less than R1. Thus, the inner edge defines a concavity in the lower portion of the dimple. The inner and outer edges meet at the opposite sides of the dimple, with the area between the edges being recessed relative to the golf ball surface. In the embodiment of FIG. 3, the inner and outer edges meet along a curved surface, with the dimple having a kidney-like shape. In the embodiment of FIG. 4, the inner 110 and outer 108 edges meet at points on the opposite sides of the dimple 106 to define a crescent-like shape.

Figure 5:
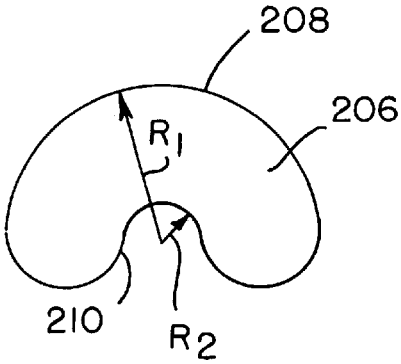
Figure 6:
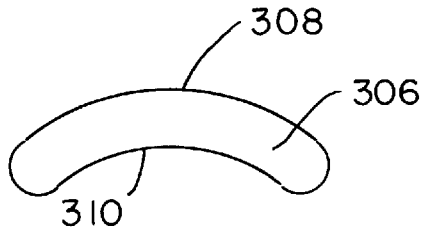

In FIG. 5, there is shown a third embodiment for a dimple 206 according to the invention wherein the second radial configuration R2 for the inner edge 210 is significantly less than the first radial configuration R1 for the outer edge 208, i.e. R2 is less than one-half of R1 resulting in a dimple with more curvature than that of the embodiment of FIG. 3. In the embodiment of FIG. 6, the second radial configuration R2 for the inner edge 310 is only slightly less than the second radial configuration for the outer edge 308 resulting in a dimple 306 having a sausage like shape.

Figure 7:
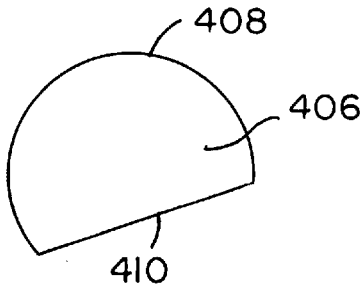

A comparison of the dimples of FIGS. 3, 5 and 7 shows the different configurations obtained resulting from the differences between R1 and R2. That is, the greater the difference, the fatter and more curved the resulting dimple. The lesser the difference, the thinner and straighter the dimple.

In the fourth embodiment for a dimple according to the invention as shown in FIG. 7, the inner edge 410 has a second radial configuration R2 =0. This results in a dimple 406 having a semi-circular configuration.

Figure 8:
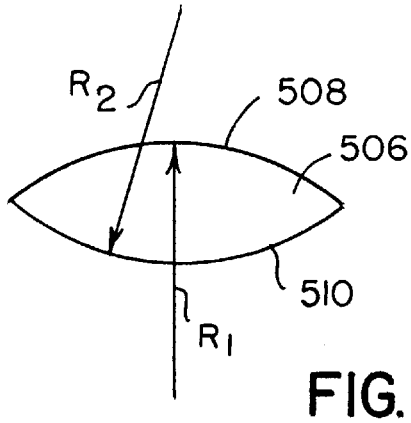

Lastly, there is shown in FIG. 8 a dimple according to a fifth embodiment of the invention. In this embodiment, the outer edge 508 has a first radial configuration R1 and the inner edge 510 has a second radial configuration R2, where R2 =R1. Here, the inner and outer edges are both convex, and the origin of the radii are different resulting in a dimple 506 having a football-like configuration.

It will be appreciated that any combination of dimple configurations can be arranged on the surface of the golf ball in either a random or specified pattern. In order to maximize dimple coverage on the golf ball surface to improve the flight characteristics thereof, it is preferable to utilize sickle-shaped dimples on the golf ball surface, with at least some of the dimples being arranged in an interlocking pattern. Referring once again to FIG. 1, the dimples X are arranged generally end to end across the surface of the golf ball and all have the same orientation of curvature. The dimples Y complement the dimples X, with the end portions of the dimples Y arranged in the concave or recess defined by adjacent dimples X. This minimizes the dimple free area of the golf ball surface. By using sickle-shaped dimples of different sizes on the ball more dimples can be fit on the ball surface using the interlocking arrangement and dimple overlap can be avoided.

While in accordance with the provisions of the Patent Statute the preferred forms and embodiments of the invention have been illustrated and described, it will be apparent to those of ordinary skill in the art that various changes and modifications may be made without deviating from the inventive concepts set forth above.

What is claimed is:

1. A golf ball having a spherical surface, comprising a plurality of dimples including (a) an outer edge having a first radial configuration; and (b) an inner edge having a linear configuration, said inner and outer edges joining at opposite sides of the dimple with the area between said edges being recessed relative to said golf ball surface to define a dimple having a semi-circular configuration, said dimples being arranged in a random pattern on said surface.

2. A golf ball having a spherical surface, comprising a plurality of dimples arranged in said surface, each of said dimples including (a) outer edges each having a convex configuration, each edge being defined by an equal fixed radius of curvature, said outer edges joining at opposite sides of the dimple with the area between said edges being recessed relative to said golf ball surface, said dimples being arranged in a random pattern on said surface.

* * * * *